United States Patent [19]

Fowler

[11] 4,384,022

[45] May 17, 1983

[54] FILAMENTARY STRUCTURE

[75] Inventor: Anthony J. Fowler, Coventry, England

[73] Assignee: Minnesota Mining and Manufacturing Co., Saint Paul, Minn.

[21] Appl. No.: 259,960

[22] Filed: May 4, 1981

[30] Foreign Application Priority Data

May 9, 1980 [GB] United Kingdom ..... 8015498

[51] Int. Cl.[3] ..... D02G 3/00

[52] U.S. Cl. ..... 428/296; 428/369; 428/370; 428/373; 428/398

[58] Field of Search ..... 428/373, 374, 397, 369, 428/370, 398, 224, 376, 296; 264/171

[56] References Cited

U.S. PATENT DOCUMENTS

| | | | |
|---|---|---|---|
| 3,686,049 | 8/1972 | Manner et al. | 156/167 |
| 3,687,759 | 8/1972 | Werner et al. | 156/167 |
| 3,691,004 | 9/1972 | Werner et al. | 161/150 |
| 3,837,988 | 9/1974 | Hennen et al. | 156/167 |
| 3,852,152 | 12/1974 | Werner et al. | 161/168 |
| 4,012,249 | 3/1977 | Stapp | 156/167 |
| 4,017,659 | 4/1977 | Brumlik | 428/397 |
| 4,048,371 | 9/1977 | Brumlik | 428/399 |
| 4,351,683 | 9/1982 | Kusilek | 156/167 |

FOREIGN PATENT DOCUMENTS

| | | |
|---|---|---|
| 7231A1 | 1/1980 | European Pat. Off. . |
| 1552629 | 9/1979 | United Kingdom . |

*Primary Examiner*—Lorraine T. Kendell

*Attorney, Agent, or Firm*—Cruzan Alexander; Donald M. Sell; Richard Francis

[57] ABSTRACT

A filamentary structure comprises a spiral thermoplastic core filament disposed within a thermoplastic sheath component, consisting either of a tube or of at least three thermoplastic filaments, the sheath component being joined to the successive turns of the spiral core filament. The spiral core filament and the sheath component may comprise the same or different thermoplastic polymers, suitable polymers being polyamides, polyesters and polyolefins.

The core filament and the sheath component may be extruded together from a spinning jet, and a plurality of the filamentary structures may be extruded side-by-side so that their sheath components are joined together to form a fabric structure.

12 Claims, 10 Drawing Figures

FILAMENTARY STRUCTURE

Figure 1:
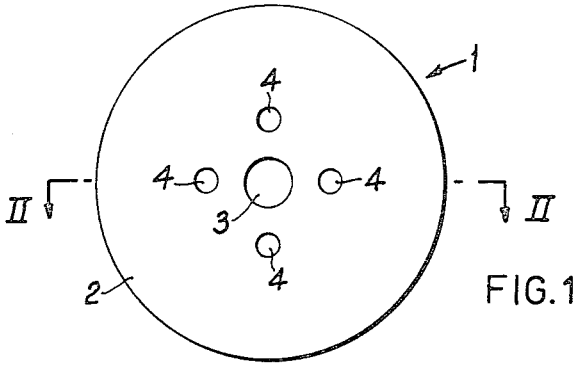

This invention is concerned with the extrusion of thermoplastic polymers to form a novel filamentary structure.

According to the invention, a filamentary structure comprises a spiral thermoplastic core filament disposed within a thermoplastic sheath component which is joined to the successive turns of the spiral core filament.

The sheath component is preferably a cage formed by at least three thermoplastic filaments each of which is joined to the successive turns of the spiral core filament. Alternatively, the sheath component may comprise a tube.

The invention includes a process for making such a filamentary structure comprising feeding molten thermoplastic polymer to a spinning jet having an inner jet hole ringed by outer jet holes, extruding the polymer through the inner jet hole at a greater velocity than polymer is extruded through the outer jet holes to form a spiral extrudate disposed within an extruded sheath component to which its successive turns are adhered, and cooling the extrudates to solidfy them to a unitary structure.

The thermoplastic polymer may be any which can be melt spun into filaments including polyamides, polyesters and polyolefins. The polymer extruded through the inner jet hole to form the spiral core may be the same as or different from the polymer extruded through the outer jet holes to form the sheath component. Preferably it is the same in order to simplify spinning and ensure good adherence between the turns of the spiral core filament and the sheath component.

An elastic filamentary structure may be formed by making the spiral core filament from a non-elastomeric polymer and the sheath component from an elastomeric polymer.

The polymer extruded through the inner jet hole is required to have a greater velocity than that flowing through the outer jet holes in order that it will take up the desired spiral form. With a common supply of molten polymer, this greater velocity may be achieved by having the inner jet hole of greater cross-sectional area and/or of shorter capillary length than each of the outer jet holes. Preferably it is of greater cross-sectional area for two reasons: the first being that in the most desirable filamentary structure of the invention the cage filaments which comprise the sheath component are of smaller cross-sectional area than the spiral core filament; and the second being that jets having holes of a common capillary length are much easier to make.

The sizes and cross-sectional shapes of the jet holes determine the size and shape of the filaments extruded through them. The preferred shape is circular, particularly for the inner jet hole. For a given spacing between the inner jet hole and the outer jet holes, the pitch of the spiral core filament is determined by the relative polymer velocities through the inner and outer holes. That is, the pitch reduces as the velocity differential increases.

Preferably, the axes of the inner and outer jet holes are all parallel to one another so that, in the embodiment where the sheath component comprises a cage of filaments, these filaments are in substantially parallel alignment with the axis of the spiral core filament.

The diameter of the spiral of the core filament is determined by the sheath component which holds it in place and which stabilises it by adhering to its successive turns. When the sheath component comprises a cage of filaments it has been found that it is necessary to have at least three cage filaments for this purpose otherwise the core filament 'breaks out' and is uncontrolled. Preferably each cage filament is spaced apart from its adjacent cage filaments by substantially equal distances. This may be arranged by using a spinning jet with a central inner jet hole ringed by at least three outer jet holes pitched at substantially equal angles to and substantially equidistant from the central inner jet hole.

The number of cage filaments can be increased to any desired number commensurate with the dictates of jet geometry. In the limit, each outer jet hole is positioned sufficiently closely to its adjacent outer jet holes that because of die swell the extruded cage filaments merge to form a tube. The outer jet holes are preferably of circular cross-section, although other suitable cross-sections may be used, for example arcuate slots which may be used to produce a tube as described.

The extruded structure may be cooled in air to solidify it, but it is preferred to stabilise it more quickly by quenching it in a liquid bath which is conveniently water.

The filamentary structure of the invention may be used as yarn, cord or twine, or as a reinforcement for a tube. In the embodiments described where the sheath component comprises a tube, it constitutes a reinforced tube itself. It may also be used to construct an abrasive pad such as a pan scrub.

The invention includes a fabric structure comprising a plurality of filamentary structures according to the invention joined to each other with the axes of the spiral filaments in substantially parallel relation. This fabric structure may be produced directly by extrusion using a bank of adjacent sets of jet holes from which adjacent filament structures are extruded. These merge and become adhered so that after being cooled to solidify them, they remain joined as a unitary fabric structure. The component filamentary structures may be arranged in a planar array by a corresponding arrangement of the adjacent sets of jet holes, to produce a planar fabric structure. Three-dimensional fabric structures may be made using appropriate groupings of the sets of jet holes from which the component filamentary structures are extruded.

The fabric structure of the invention has a variety of uses including use as drainage, earth-support and other civil engineering fabrics, and as matting such as door mats.

In the embodiment of the invention where the sheath component comprises a cage of filaments, limited stretching of the filamentary structure produces elongation of the cage filaments between the successive points of adherence, with the result that after removal of the stretching forces and contraction of the spiral core, the cage filaments balloon out between the adherence points giving an expanded structure.

Greater stretching causes the cage filaments to break between the points where they are joined to the spiral core filament, close to those points, to produce a modified filamentary structure which is a further aspect of the invention. The broken cage filaments constitute fibrils which are substantially uniform in length, with the majority of the fibrils being raked in a common direction.

The modified filamentary structure has decorative qualities and may be used as fancy yarn, or twine, especially if coloured. The rake of the fibrils gives it a particularly distinctive appearance and also imparts good knot-tying properties. The roughness of the fibrils, particularly at the adherence points, gives the product abrasive properties making it suitable for the construction of scouring pads, for example.

Figure 2:
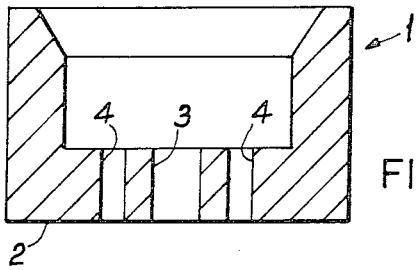
Figure 3:
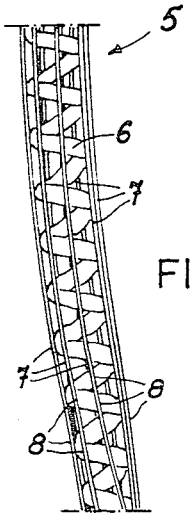
Figure 4:
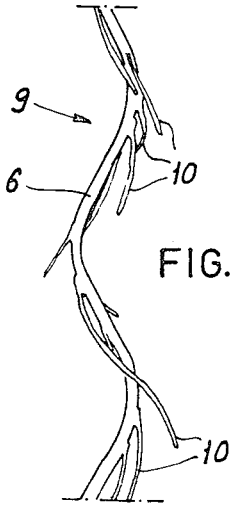
Figure 5:
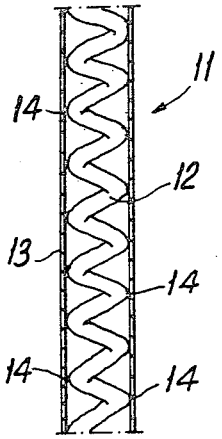
Figure 6:
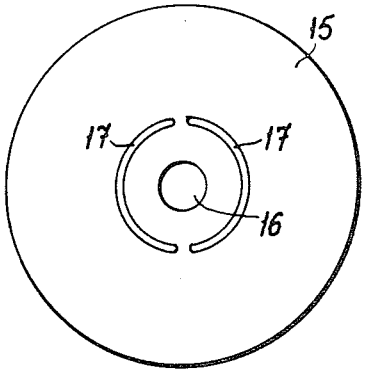
Figure 7:
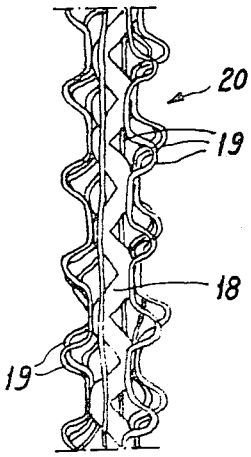
Figure 8:
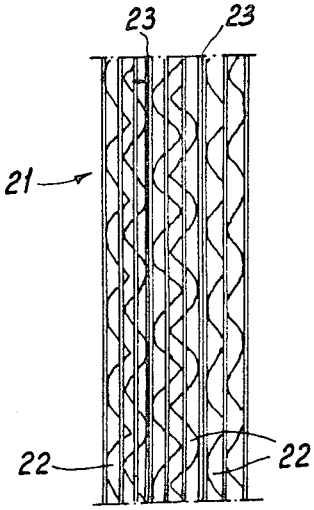
Figure 9:
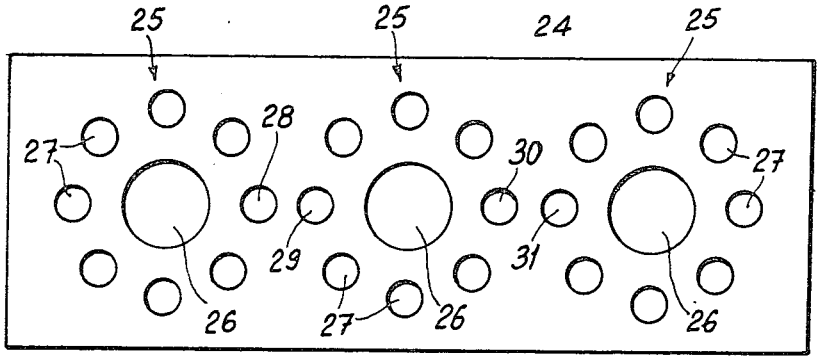
Figure 10:
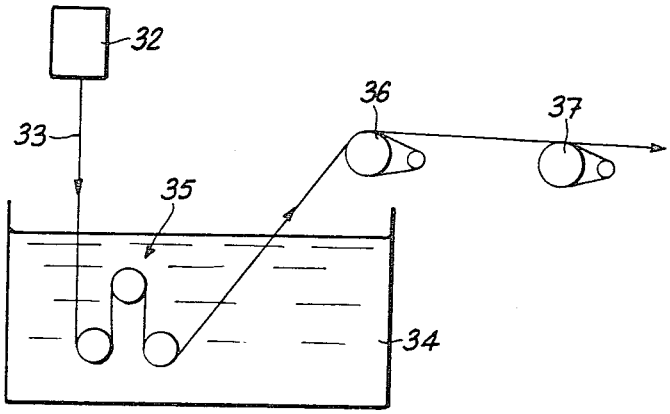

The invention is illustrated by the accompanying drawings in which:

FIG. 1 is a plan of the face of a jet suitable for use in the process of the invention, FIG. 2 is a cross-section on the line II—II of FIG. 1, FIG. 3 is an elevation of a filamentary structure in accordance with the invention, FIG. 4 is an elevation of a modified filamentary structure formed by stretching the structure of FIG. 3, FIG. 5 is a sectional elevation of another filamentary structure in accordance with the invention, FIG. 6 is a plan, on an enlarged scale, of the face of a jet suitable for spinning the filamentary structure shown in FIG. 5, FIG. 7 is an elevation of the structure of FIG. 3 after being partially stretched, FIG. 8 is an elevation of a fabric structure in accordance with the invention, FIG. 9 is a plan, on an enlarged scale, of the face of a jet suitable for spinning the fabric structure shown in FIG. 8, and FIG. 10 is a diagram of apparatus for spinning a filamentary structure in accordance with the invention.

Referring to FIGS. 1 and 2, a spinning jet 1 has a circular jet face 2 in which are drilled an inner jet hole 3 encircled by a ring of four outer jet holes 4. The jet holes have the same capillary length and the inner jet hole is shown as about twice the diameter of the outer jet holes.

FIG. 3 shows a filamentary structure 5 spun from a jet similar to that shown in FIGS. 1 and 2, but comprising eight outer jet holes instead of four. The filamentary structure 5 comprises a spiral core filament 6 held within a cage of eight finer filaments 7 which are joined to the successive turns of the spiral core filament at points 8.

FIG. 4 shows a modified filamentary structure 9 produced by stretching the structure 5, whereby the cage filaments 7 have broken close to the points 8. The resulting fibrils 10 are regularly spaced and uniform in length. As shown they are raked in a common direction. The points at which they are joined to the core filament 6 lie on a generally spiral path around the core filament.

The filamentary structure 11 shown in FIG. 5 comprises a spiral core filament 12 held within a tubular sheath 13 which is joined to the successive turns of the spiral core filament at points 14. The structure 11 may be spun from a jet of the type shown in FIG. 6 in which the jet 15 has a central inner jet hole 16 ringed by two outer jet holes 17 in the form of two arcuate slots. The extrudates from the outer jet holes merge below the jet to form a tube enclosing the spiral core filament formed from the higher velocity extrudate from the inner jet hole.

FIG. 7 shows a filamentary structure of the type shown in FIG. 3 after being stretched to a degree which elongates the cage filaments without breaking them. On being allowed to relax, the spiral core filament 18 contracts and causes the elongated cage filaments 19 to balloon out as shown to produce an expanded filamentary structure 20.

The fabric structure 21 shown in FIG. 8 comprises three filamentary structures of the type shown in FIG. 3 with the axes of their spiral core filaments 22 parallel and adjacent cage filaments 23 fused together. This fabric structure may be produced by a jet of the type shown in FIG. 9 which has a rectangular jet face 24 with three sets 25 of jet holes lying adjacent to each other in a line. Each set 25 comprises an inner jet hole 26 ringed by eight outer jet holes 27 of smaller diameter. The cage filaments extruded from the adjacent pairs of outer jet holes 28, 29 and 30, 31, respectively, merge below the jet face to join the extruded filamentary structures together as a fabric.

The number of sets of jet holes may be extended beyond three to produce wider fabric structures, and may also be grouped other than in line, for example as a grid, to provide three-dimensional fabric structures.

In FIG. 10, the apparatus shown diagrammatically comprises a spinning jet 32 from which a filamentary structure 33 according to the invention is extruded downwardly into a water quench bath 34. The solidified structure is withdrawn from the jet by driven rollers 35 in a 'clover leaf' formation and located below the surface of the bath. The structure is withdrawn from the bath by a godet 36 and, if desired, stretched between the godet 36 and a further godet 37 to produce a structure as shown in FIG. 4 or FIG. 6 depending upon the degree of stretch.

The invention is illustrated by the following Examples:

EXAMPLES 1 TO 6

Nylon 6 polymer was melted and extruded through various spinning jets as shown in FIGS. 1 and 2 of the drawings, some with four outer jet holes and some with eight outer jet holes with variations also in the pitch circle diameter (PCD) of the outer jet holes. The extrudates were quenched in a water bath at room temperature and collected either by free fall or by nip rollers. Samples were taken and stretched at two different percentage stretches, one simply to bulk the product and the other a greater stretch to break the cage filaments and produce the modified filamentary structure.

The following jet dimensions and process conditions were common to all six Examples. Other conditions which varied between Examples and the product properties are shown in the succeeding Table.

| | |
|---|---|
| Inner jet hole diameter | 350 μm |
| Outer jet hole diameter | 175 μm |
| Capillary length of all jet holes | 437 μm |
| Head temperature of jet | 260° C. |
| Polymer throughput | 13.46 g/min. |

TABLE

| Example | 1 | 2 | 3 | 4 | 5 | 6 |
|---|---|---|---|---|---|---|
| Number of outer jet holes | 8 | 8 | 4 | 4 | 8 | 8 |
| PCD of outer jet holes (μm) | 844 | 844 | 900 | 900 | 1000 | 1000 |
| Distance from jet face to quench bath (cm) | 1.5 | 10 | 1.5 | 10 | 1.5 | 10 |
| Take-up speed m/min | 13.3 | Free Fall | 17.7 | Free Fall | 12 | Free Fall |
| Diameter of extrudate (cm) | 0.18 | 0.21 | 0.20 | 0.25 | 0.21 | 0.23 |
| Diameter of spiral | | | | | | |

TABLE-continued

| Example | 1 | 2 | 3 | 4 | 5 | 6 |
|---|---|---|---|---|---|---|
| core filament (cm) | 0.07 | 0.07 | 0.07 | 0.07 | 0.07 | 0.07 |
| Pitch of spiral (cm) | 0.21 | 0.17 | 0.31 | 0.30 | 0.22 | 0.21 |
| Direction of spiral (cw or acw)* | acw | acw | cw | acw | cw | cw |
| Diameter of cage filaments (cm) | 0.02 | 0.025 to 0.030 | 0.02 | 0.020 to 0.028 | 0.025 | 0.025 |
| Weight/unit length of extrudate (g/m) | 0.973 | 1.311 | 0.760 | 0.886 | 1.210 | 1.260 |
| Stretch to bulk (percent) | 120 | 130 | 100 | 110 | 130 | 120 |
| Stretch to break (percent) | 425 | 400 | 500 | 520 | 420 | 410 |
| Percentage of fibrils raked towards jet | 95 | 70 | 95 | 95 | 90 | 95 |
| away from jet | 5 | 30 | 5 | 5 | 10 | 5 |

*cw = clockwise
acw = anticlockwise

What is claimed is:

1. A filamentary structure produced directly by extrusion comprising a thermoplastic core filament extending in successive turns of a spiral about an axis, and thermoplastic sheath filaments, at least three in number, which extend linearly generally in the direction of said axis along the outside of the spiral and together form a cage thereabout, each of said sheath filaments being thermoplastically fused at spaced locations to the outside of each successive turn of said spiral core filament.

2. A filamentary structure as claimed in claim 1, in which each sheath filament is spaced apart from its adjacent sheath filaments by substantially equal distances.

3. A filamentary structure as claimed in claim 1 or 2, in which the sheath filaments are in substantially parallel alignment with the axis of the spiral core filament.

4. A filamentary structure as claimed in claim 1 or claim 2, in which each of the sheath filaments is of smaller cross-sectional area than the spiral core filament.

5. A filamentary structure as claimed in claim 1 or claim 2, in which the spiral core filament and/or the sheath filaments are of substantially circular cross-section.

6. A filamentary structure as claimed in claim 1, or claim 2, in which the spiral core filament and the sheath filaments comprise the same thermoplastic polymer.

7. A filamentary structure as claimed in claim 1, or claim 2, in which the spiral core filament and the sheath filaments comprise different thermoplastic polymers.

8. A filamentary structure as claimed in claim 1, or claim 2, in which the spiral core filament comprises a non-elastomeric polymer and the sheath filaments comprise an elastomeric polymer.

9. A filamentary structure as claimed in claim 1, or claim 2, in which the spiral core filament and/or the sheath filaments comprise a polyamide or a polyester or a polyolefin.

10. A filamentary structure comprising a thermoplastic core filament extending in successive turns of a spiral about an axis, and a tubular thermoplastic sheath extending co-axially with said spiral core filament along the outside of the spiral, the tubular sheath being thermoplastically fused to the outside of each successive turn of said spiral core filament.

11. A fabric structure comprising a plurality of filamentary structures as claimed in claim 1, claim 2 or claim 10 extending in adjacent relation with the axes of the respective spiral core filaments substantially parallel, adjacent filamentary structures being thermoplastically fused together along their lengths.

12. A fabric structure as claimed in claim 11 in which the adjacent filamentary structures form a planar array.

* * * * *